United States Patent [19]

Rossi et al.

[11] 4,088,589

[45] May 9, 1978

[54] DUAL POUR DEPRESSANT COMBINATION FOR VISCOSITY INDEX IMPROVED WAXY MULTIGRADE LUBRICANTS

[75] Inventors: Albert Rossi, Warren; William J. Fernandez, Kearny, both of N.J.

[73] Assignee: Exxon Research & Engineering Co., Linden, N.J.

[21] Appl. No.: 688,186

[22] Filed: May 20, 1976

[51] Int. Cl.[2] ..... C10M 1/24

[52] U.S. Cl. ..... 252/56 R; 252/59

[58] Field of Search ..... 252/56 R

[56] References Cited

U.S. PATENT DOCUMENTS

| | | | |
|---|---|---|---|
| 1,963,917 | 6/1934 | MacLaren | 252/58 |
| 1,963,918 | 6/1934 | MacLaren | 252/58 X |
| 2,091,627 | 8/1937 | Bruson | 252/56 R |
| 2,936,300 | 5/1960 | Tutwiler et al. | 252/56 R X |
| 3,136,743 | 6/1964 | Conway et al. | 252/56 R X |
| 3,324,034 | 6/1967 | Merz et al. | 252/56 R |
| 3,475,321 | 10/1969 | Henselman et al. | 252/56 R X |
| 3,522,180 | 7/1970 | Sweeney et al. | 252/59 |
| 3,551,336 | 12/1970 | Jacobsson et al. | 252/59 |
| 3,697,429 | 10/1972 | Engel et al. | 252/59 |

*Primary Examiner*—Delbert E. Gantz
*Assistant Examiner*—Andrew H. Metz
*Attorney, Agent, or Firm*—Roland A. Dexter

[57] ABSTRACT

Multigrade lubricating oils blended from petroleum distillates and, if desired, a bright stock containing waxy or wax-like components and modified by the presence of copolymeric ethylene-higher alpha-olefins viscosity index improving agents have their low temperature performance markedly improved when said copolymer contains a minor weight proportion of ethylene by the addition of from about 0.15 to about 1, preferably 0.2 to 0.5, wt. %, based upon the total weight of said lubricating oil composition of a combination of pour point depressants comprising: (a) from about 0.05 to about 0.75 wt. % of an oil-soluble condensation product of a chlorinated wax of from about 10 to about 50 carbon atoms and a mono- or dinuclear aromatic compound; and (b) from about 0.05 to about 0.75 wt % of an oil-soluble polymer of $C_{10-18}$ alkyl acrylate or methacrylate and/or an interpolymer of a vinyl alcohol ester of a $C_2$ to $C_{18}$ alkanoic acid and di($C_6$-$C_{18}$ alkyl) fumarate.

10 Claims, No Drawings

DUAL POUR DEPRESSANT COMBINATION FOR VISCOSITY INDEX IMPROVED WAXY MULTIGRADE LUBRICANTS

BACKGROUND OF THE INVENTION

1. Field of the Invention

This invention relates to a combination of pour point depressants formulated into petroleum lubricants containing waxy or wax-like components and ethylene-copolymeric viscosity index improving agents. More particularly, this invention is concerned with a mixture of an oil-soluble, condensation product of chlorowax/-naphthalene and a second pour point depressant of the class of a polymer of an ester of acrylic acid or methacrylic acid and a monohydric alcohol containing from about 10 to about 18 carbon atoms and/or an interpolymer obtained from a mixture of a vinyl alcohol ester of a $C_2$ to $C_{18}$ alkanoic acid and a di($C_6$–$C_{18}$ alkyl) fumarate whereby the low temperature performance of lubricating oils blended from light and heavy petroleum components with a viscosity index improving amount of an ethylene copolymeric viscosity index improving agents are materially improved.

Present day motor oils for the lubricating of internal combustion engines are usually petroleum or mineral oils of suitable viscosity compounded with one or more addition agents to impart various desired properties thereto.

Among the usual addition agents employed are so-called detergent type additives and viscosity index (V.I.) improvers, the latter being used to modify the viscosity-temperature characteristics of the oil. Such types of V.I. improvers included the oil-soluble polymerization products of an ester of acrylic acid or its alpha-alkyl substitution products and monohydric alcohols containing more than 4 carbon atoms preferably from about 4 to about 18 carbon atoms, (see U.S. Pat. Nos. 2,091,627, 2,100,993 and 2,407,954).

Other known V.I. improvers include polyisobutylene, copolymers of vinyl esters and fumaric acid esters, alkyl styrenes and copolymers of styrene and alkenes or alkylidenes, acrylate and methacrylate esters with and without nitrogen-containing esters. Highly useful V.I. improving agents are polymers of ethylene and $C_3$ to $C_{18}$ olefins. Examples of these copolymers, made with the aid of Ziegler-Natta catalysts are described in U.S. Pat. Nos. 3,522,180, 3,551,336 and 3,697,429.

The term "pour point" is used to denote the lowest temperature at which an oil will pour or flow when chilled without disturbance under specified conditions. The pour point of a refined lubricating oil was previously believed of practical importance in order to avoid problems of engine lubrication at low temperatures.

At the present time, the pour point test (ASTM D-97) is generally recognized to be deficient in predicting operation preformance.

It is known to use combinations of pour depressants in lubricating oils for U.S. Pat. No. 2,916,447 teaches that octane requirement of a spark ignition internal combustion engine can be reduced by incorporating from about 0.5% to about 10% of a condensation product of a long chain chlorinated alkyl hydrocarbon of from about 10 to about 50 carbon atoms and a mono- or dinuclear aromatic compound into a motor oil containing from about 0.5% to about 15% of an oil-soluble polymer of an ester of acrylic acid or of its alpha-alkyl or alpha-phenyl substitution products and a monohydric alcohol containing from 4 to about 18 carbon atoms, and from about 0.5% to about 10% of a neutralized polyvalent metal-containing phosphorus- and sulfur-containing detergent additive.

Frequently it is found that the presence of V.I. improver additives in conventionally-formulated lubricating oils undesirably raises the pour point of the lubricating oil to a point which renders the oil less than fully satisfactory at low temperature. This appears to occur, at least in part, because the VI improvers employed interfere with the operation of conventional lubricating oil pour point depressants.

Such a low temperature difficulty involving ethylene copolymeric V.I. improvers was overcome in U.S. Pat. No. 3,697,429. It is taught therein that a low pour, solvent-refined, midcontinent lubricant base stock containing an additive package, including a mixture of the condensation product of naphthalene and chlorinated wax and the condensation product of di($C_8$–$C_{18}$ alkyl) fumarate and vinyl acetate, can be usefully viscosity modified with an ethylene-propylene copolymeric mixture of high and low ethylene content copolymers.

It is an object of this invention to provide a system which permits attainment of improvement in viscosity index of lubricating oils of high wax content particularly those blended from light and heavy petroleum components (distillation cuts and extracted residues).

SUMMARY OF THE INVENTION

It has now been discovered that petroleum lubricating oils of high wax content, especially mineral lubricating oils blended from a major proportion of at least one light blending distillate having a viscosity of from 63 to 77 Saybolt Universal Seconds (hereafter designated SUS) at 37.8° C. and a second light blending distillate having a viscosity of from 138 to 152 SUS at 37.8° C. and preferably a minor proportion of a heavy petroleum component which have been compounded with viscosity-index improving copolymer of ethylene and a higher olefin, e.g. a $C_3$ to $C_{18}$ alpha olefin, e.g. propylene, can be usefully modified in low temperature operability by the addition of from about 0.15 to about 1, preferably 0.2 to 0.5, wt. % of a mixture of pour point depressants when said copolymer is present in at least a viscosity index improving amount and has a minor weight, preferably from about 40 to 50 weight percent, proportion of ethylene. This useful mixture of lubricating oil pour point depressants comprises:

(a) from about 0.05 to about 0.75 wt. %, preferably 0.1 to 0.3, of an oil-soluble condensation product of a chlorinated long-chain alkyl hydrocarbon having from about 10 to about 50 carbon atoms and an aromatic compound selected from the class consisting of a mononuclear aromatic hydrocarbon, a mono-nuclear hydroxy aromatic compound, a dinuclear aromatic hydrocarbon and a dinuclear hydroxy aromatic compound; and (b) from about 0.05 to about 0.75 wt. % of an oil-soluble polyester pour point depressant of the class consisting of a polymeric ester of acrylic acid or methacrylic acid and a monohydric alcohol containing from 10 to 18 carbon atoms and/or an interpolymer of a vinyl alcohol ester of a $C_2$ to $C_{18}$ alkanoic acid and a di($C_6$–$C_{18}$ alkyl) fumarate. Preferably, the weight ratio of (a):(b) ranges from about 3:1 to 1:3, and optimally said ratio ranges from about 2:1 to 1:2.

A preferred mixture or combination is from about 0.3 to 3 parts by weight of the reaction product of a wax-naphthalene condensation having a Mn ranging from about 1000 to 3000, e.g. 2000, to about 1 part by weight of a poly($C_{10}$–$C_{18}$) alkyl ester of methacrylic acid having a Mn of from about 5000 to about 35,000, e.g. 25,000. This preferred combination is particularly useful when the blended lubricating oil according to this invention has greater than about 55 wt. % of said light blending distillate components having a viscosity of less than about 170 SUS at 37.8° C.

DESCRIPTION OF PREFERRED EMBODIMENT

1. Viscosity Index Improving Ethylene Copolymers

As earlier indicated, the oil-soluble hydrocarbon polymeric viscosity index improver additives contemplated to be compounded into the lubricating oil in accordance with this invention are ethylene copolymers wherein the weight content of ethylene is a minor proportion of said copolymer (hereinafter called low ethylene content ethylene copolymer). It is preferred that the ethylene content range from about 40 to about 50, optimally about 44, weight percent of the total weight of said copolymer. These low ethylene content ethylene copolymers have a number average molecular weights ($\overline{M}n$) of from about 20,000 to about 300,000, preferably 40,000 to 200,000 and optimally from about 50,000 to 100,000. In general, said copolymers having a narrow range of molecular weight, as determined by the ratio of weight average molecular weight ($\overline{M}w$) to number average molecular weight ($\overline{M}n$) are preferred. Polymers having a $\overline{M}w/\overline{M}n$ of less than 10, preferably less than 7, and most preferably 4 or less are most desirable. As used herein ($\overline{M}n$) and ($\overline{M}w$) are measured by the well known techniques of vapor pressure (VPO) and membrane osmometry and/or gel permeation chromatography, respectively. These hydrocarbon polymers are prepared from ethylenically unsaturated hydrocarbons, including cyclic, alicyclic and acyclic, containing from 2 to 30 carbons. Low ethylene content ethylene-alpha-olefin copolymers are fully described including their methods of preparation in U.S. Pat. No. 3,697,429 which is incorporated herein by reference thereto.

The higher alpha-olefins which may be used in the preparation of the ethylene copolymers used in practice of this invention may include those monomers typically containing from 3 to about 18 carbon atoms. The alpha-olefins may be linear, or branched where the branching occurs three or more carbon atoms from the double bond. While a single olefin is preferable, mixtures of $C_3$ to $C_{18}$ olefins may be employed. Suitable examples of $C_3$ to $C_{18}$ alpha-olefins include propylene, 1-butene, 1-pentene, 1-hexene, 1-heptene, 1-octene, 1-nonene, 1-decene, 4-methyl-1-pentene, 4-methyl-1-hexene, 5-methyl-1-hexene, 4,4-dimethyl-1-pentene, 4-methyl-1-heptene, 5-methyl-1-heptene, 6-methyl-1-heptene, 4,4-dimethyl-1-hexene, 5,6,5-trimethyl-1-heptene and mixtures thereof. It is preferred, however, that the ethylene monomer be copolymerized with propylene.

These low ethylene content ethylene copolymers may be readily prepared using soluble Ziegler-Natta catalyst compositions which are well known in the art. For recent reviews of the literature see: "Polyolefin Elastomers Based on Ethylene and Propylene", by F. P. Baldwin and G. VerStrate in Rubber Chem. & Tech. Vol. 45 No. 3, 709–881 (1972) and "Polymer Chemistry of Synthetic Elastomers" edited by Kennedy and Tornqvist, Interscience, New York, N.Y. (1969).

The low ethylene content ethylene-propylene copolymers constituting the preferred V.I. improver additives according to this invention are illustratively prepared as follows:

(a) copolymerization of ethylene and propylene at 35° C. and 65 psig, using $VOCl_3$ catalyst and $(C_2H_5)_3Al_2Cl_3$ as cocatalyst and with an ethylene to propylene mole ratio of 0.9 provides a copolymer containing 44 wt. % ethylene;

(b) a copolymer of ethylene and propylene containing 41 wt. % ethylene can be prepared at 55° C. and 65 psig by the use of a catalyst composition containing $VOCl_3$ as catalyst and $(C_2H_5)_3Al_2Cl_3$ as cocatalyst, with an ethylene to propylene mole ratio of 0.5; and, (c) a copolymer of ethylene and propylene containing 43 wt. % can be prepared at 55° C. and 65 psig by the use of a catalyst composition containing vanadium tris-(acetonylacetate) as catalyst and $(C_2H_5)_3Al_2C_13$ as cocatalyst, with an ethylene to propylene mole ratio of 0.8.

For ease of carrying out this invention the copolymers are dissolved in a solvent such as mineral oil to provide an additive for compounding with the lubricating oil blended base stock.

Oil-Soluble Alkyl Aromatic Condensation Product-Pour Point Depressants

The long chain alkyl-aromatic hydrocarbon condensation product useful in the present invention is preferably a condensation product of a paraffin wax and naphthalene. Such a condensation product is prepared by heating a mixture of a chlorinated paraffin wax with the naphthalene to a temperature of from about 60° C. to about 180° C. preferably in the approximate temperature range of 120° C. to 160° C. in the presence of a Friedel-Crafts type catalyst, such as aluminum chloride. Upon completion of the condensation, the sludge formed is removed and the sludge-free product neutralized with caustic and water-washed. The wax aromatic condensation products and their preparation are fully described in U.S. Pat. Nos. 1,963,917 and 1,963,918, issued to F. H. MacLaren et al, Oct. 13, 1936. The condensation products described in these patents are known as "Pourex." Other similar condensation products, marketed as "Paraflow," are described in U.S. Pat. No. 1,815,022 issued to G. Davis, July 14, 1931, and U.S. Pat. No. 2,174,246 issued to Lieber, et al, Sept. 26, 1939.

Other related condensation products which can be suitably used are: condensation products of paraffin wax and a mono- or dinuclear alkylated hydroxy aromatic compound and their esters such as are described in U.S. Pat. No. 2,191,498 and 499 and U.S. Pat. No. 2,138,809; condensation products of mono- or dinuclear hydroxy aromatic compounds and chlorinated wax which are described in U.S. Pat. No. 2,061,008 and U.S. Pat. No. 2,062,676; and, acylated condensation products of a mono-or dinuclear hydroxy aromatic compound and chlorinated wax of the type described in U.S. Pat. No. 2,138,809.

Optimally, the preferred wax-naphthalene condensation product has a weight average molecular weight ($\overline{M}w$) of about 1000 to 3000, usually about 2000.

Oil-Soluble Polyester Pour Point Depressants

These oil soluble polyester pour point depressants which include polymers of acrylates (including homologues of acrylates) and fumarates will generally have a Mn in the range of about 1,000 to 200,000, preferably 2,000 to 30,000 as measured, for example, by membrane osmometry. In accordance with this invention, at least about 25 wt. %, preferably at least about 50 wt. % of the polyester depressant will be derived from a substantially straight chain alkyl monocarboxylic acid ester monomer moiety, said alkyl groups extending from the ester linkages having from 12 to 18 carbons.

The esters of monocarboxylic acids useful for preparing these polyesters are represented by the general formula (acrylic esters including homologues thereof);

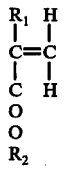

wherein $R_1$ is hydrogen or a methyl group and $R_2$ is predominantly a $C_{10}$ to $C_{18}$ alkyl group.

Compounds of the above type whose oil-soluble polymers are useful for the present purpose are the esters of acrylic acid, its alpha-alkyl homologue and monohydric alcohols containing ten or more carbon atoms such as the decyl, lauryl, myristyl, cetyl, etc. These esters are preferably those of the normal, primary saturated aliphatic alcohols, but the analogous esters of the corresponding linear Oxo alcohols can also be used.

Effective polymers for the present purpose, from the point of view of availability and cost, are the polymerized esters of acrylic acid or methacrylic acid and monohydric, saturated, primary aliphatic alcohols containing from 12 to 16 average carbon atoms per molecule as represented by Neodol-25 methacrylate, Lorol methacrylate, cetyl methacrylate, tallow methacrylate, Alfol 10-18 methacrylate and mixtures thereof.

A preferred class of these second polymers are methacrylate ester copolymers of the formula

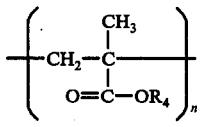

where $R_4$ is a mixture of alkyl groups containing from 12 to 18 carbon atoms and $n$ is a number providing a molecular weight of the copolymer of about 2000 to 100,000 ($\overline{Mn}$). A very satisfactory material of this type is a copolymer wherein $R_4$ of the above formula is predominantly a mixture of $C_{12}$ to $C_{16}$ alkyl groups in the proportion of about 10–25% dodecyl, 15–30% tridecyl, 15–25% of tetradecyl, 10–20% of pentadecyl and 10–15% of hexadecyl and all six groups comprise at least about 85 wt. % of the alkyl groups and have a molecular weight ($\overline{Mn}$) within the range of 10,000 to 30,000 and which is readily soluble in a mineral lubricating oil.

A commercial pour point depressant of a suitable methacrylate type is sold under the trade name of "Acryloid 152" by Rohm and Haas, wherein about 43 wt. % of $R_4$ is a mixture of tetradecyl, pentadecyl and hexadecyl alkyl groups and the molecular weight of the polymer is about 10,000–30,000 (Mn). This commercial methacrylate copolymer is sold as an oil additive in the form of about a 40% concentrate of the active polymer in a light colored mineral lubricating oil base, providing a clear amber-colored viscous liquid. Preparation of such a polyester has been generally described in U.S. Pat. Nos. 2,091,627 and 2,100,993.

Another group of polyesters are the copolymers of di($C_6$–$C_{18}$ alkyl) fumarate and vinyl acetate which are typified by those set forth in U.S. Pat. No. 2,936,300.

The useful fumarates have the general formula:

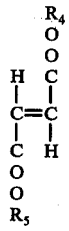

wherein $R_4$ and $R_5$ are independently selected from the class of H and long chain alkyl groups of 6 to 18 carbons, preferably of 10 to 16 carbons whereby average number carbon contents of $R_4$ and $R_5$ are from 13 to 15. The fumarates of the general formula are prepared from $C_6$ to $C_{18}$ alcohol mixtures, preferably mixtures of straight chain, saturated primary alcohols as are derived from commercially available alcohols such as NEODOL 25, NEODOL 45, ALFOL 10–18, LOROL, tallow, cetyl, etc. and according to the general procedures detailed in U.S. Pat. No. 2,936,300.

The fumarates are copolymerized with vinyl $C_2$–$C_8$, preferably $C_2$–$C_5$, alkanolates, such as vinyl acetate as earlier noted. The molar ratio of vinyl alkanolate to di(alkyl) fumarates ranges from 0.6 to 1.3, preferably about 0.9, of the vinyl alkanolate/di(alkyl) fumarate copolymers.

The ester polymers are generally prepared by polymerizing the ester monomers in a solution of a hydrocarbon solvent such as heptane, benzene, cyclohexane, or white oil, at a temperature generally in the range of from 50° C. to 125° C. and usually promoted with a perioxide type catalyst such as benzoyl peroxide, under a blanket of an inert gas such as nitrogen or carbon dioxide in order to exclude oxygen (see U.S. Pat. No. 2,936,300).

For the purposes of this disclosure an oil-soluble polymer or copolymer has a solubility in oil of at least about 0.001% by weight at 20° C.

Lubricating Oil Base Stock

This invention is applicable to improvement of the cold temperature performance lubricating oil base stocks which have been compounded with a V.I. ethylene copolymeric additive and if desired with various other oil additives including: ashless dispersants such as the reaction product of polyisobutenyl succinic anhydride with tetraethylene pentamine; detergent type additives such as barium nonyl phenol sulfide, calcium petroleum sulfonate, nickel oleate, an antioxidant such as a phenolic antioxidant; pressure additive such as a zinc dialkyl dithio phosphate; an antirust agent; etc.

Base stock oils for the preparation of lubricating oils can be prepared from vacuum distillation fractions or residues of the vacuum distillation of crude mineral oils. These oils can also be prepared by hydrocracking mineral oil and subsequently hydrogenating the products with the object of increasing their oxidative stability which provides a heavy hydrotreated blending component.

The lubricating oils which are improved in accordance with this invention are blends of at least two light petroleum blending distillates, i.e. a first light distillate having a viscosity of from about 63 to 77 SUS at 37.8° C. and a second light distillate having a viscosity of from about 138 to 152 SUS at 37.8° C. to provide the major weight proportion, i.e. greater than about 50 wt. %, of the lubricating oil composition. It is preferred that at least 55 wt. % of the lubricating oil composition be of light blending distillate components each having a viscosity of less than 170 SUS at 37.8° C.

It is advantageous to have the blended lubricating oil composition contain a minor weight proportion of up to about 30 wt. %, preferably from 5 to 20 wt. % of a heavy petroleum component. For purposes of this disclosure a heavy petroleum component is represented by a bright stock having a viscosity of 125 to 165 SUS, preferably 145 SUS, at 99° C., or a heavy hydrotreated residue having a viscosity of 65 to 105 SUS, preferably 85 SUS at 99° C.

The invention will be further understood by reference to the following examples which include preferred embodiments of the invention.

Additive A

The viscosity index improving ethylene copolymer used in the examples of this invention is an ethylene-propylene copolymer (Polymer A) having an ethylene content about 44 wt. % (54 mole %) and a (Mn) of about 50,000. To prepare such a copolymer of this embodiment, 30 parts of ethylene, 4.9 parts of propylene and $6 \times 10^{-5}$ parts of hydrogen is admitted to suitable reaction vessel together with 100 parts of diluent-solvent n-heptane, 0.0094 parts of vanadium oxychloride $VOCl_3$ catalyst and 0.034 parts of ethyl aluminum sesquichloride. The catalyst composition was characterized by a molar ratio of Al/V of 5.0. After an effective residence time of 20 minutes, a product stream may be recovered and steam distilled to yield a solvent-free crude product which may then be dried to yield the ethylene-propylene copolymer described above. The product copolymer is dissolved in Solvent 100N mineral oil to provide about a 5 wt. % solution of said copolymer to provide the additive and to facilitate compounding in the lubricating oil.

ADDITIVE B

A chlorowax naphthalene condensation product (Polymer B) having a $\overline{Mn}$ of about 2000 was produced as by the process described in U.S. Pat. No. 2,174,246 and dissolved in Solvent 100N oil as about a 30 wt. % solution.

Additive C

A polymer of $C_{12}$-$C_{20}$ linear alkyl methacrylate esters (Polymer C) having a (Mn) of about 25,000 in which the alkyl groups are predominantly dodecyl, tridecyl and tetradecyl (average of about 13 carbons in alkyl group) which may be prepared according to U.S. Pat. No. 2,091,627. This polyester Polymer C was dissolved in a light mineral oil as about a 60 wt. % solution.

Additive D

A polymer comparable to polymer C of $C_{12}$-$C_{20}$ linear alkyl methacrylate esters having a ($\overline{Mn}$) of 24,000 in which the alkyl groups averaged about 14 carbons. This Polymer D was also dissolved in a light mineral oil as about a 60 wt. % solution.

Additive E

Polymer E was a copolymer of dialkyl fumarate and vinyl acetate having a ($\overline{Mn}$) of about 15,000. The alkyl groups of the fumarate were derived from a mixture of $C_{10}$-$C_{18}$ alcohols. The fumarate to acetate molar ratio was substantially 1. The Polymer E was prepared according to U.S. Pat. No. 2,936,300 and dissolved in Solvent 100N mineral oil as about a 40 wt. % solution to provide additive E.

Lubricating Oil

Two lubricating oil base stocks were each blended with two light blending distillates and a heavy petroleum component for subsequent compounding with the low ethylene content ethylene copolymeric V.I. improver, i.e. Polymer A. Each base stock was blended and compounded by admixing together of the components at a temperature of about 140° C. The blends are hereafter set forth in Table I as a multigrade 10 W-30 lubricating oil composition.

TABLE I

| Component | Viscosity | Type 1 | Type 2 |
|---|---|---|---|
| Solvent 70N | 70 SUS at 38° C. | 18.6 | 18.6 |
| Solvent 145N | 145 SUS at 38° C. | 46.7 | 46.7 |
| Heavy hydrotreated residue | 85 SUS at 99° C. | 11.7 | — |
| Bright Stock | 145 SUS at 99° C. | — | 11.7 |
| Additive A | | 10 | 10 |
| D.I.* | | 12.7 | 12.7 |

*A typical detergent inhibitor package of the type described in U.S. Pat. No. 3,697,429 of an ashless dispersant, antioxidant-antiwear agent and overbased metal phenate detergent.

Low Temperature Can Pour Test

The can pour test is believed more reliable in predicting sufficiency low temperature engine lubricity of lubricating oil compositions than the pour point test, (ASTM D-97). The can pour test was therefore used to evaluate the useful modification of low temperature operability of lubricating oils types 1 and 2 which are representative of lubricating oils blended from light and heavy petroleum components.

The can pour test measures the time required to dispense 850 ml. of lubricating oil compositions from a quart can of the type used to package lubricating oils for sale at a service station. The quart can is provided with spout of the type used at stations.

The sample to be tested is placed cold box and cooled by reducing the ambient temperature of the cold box from 40° F. at the rate of 3° F./hour until −20° F. is reached at which time the quart can with spout is inverted so that the lubricating oil composition can flow into a 1000 ml. graduated cylinder. The time required for dispensing said 850 ml. is measured and if it is less than 15 minutes the time is recorded but if more than 15 minutes, the amount dispensed is recorded (ml) but defined as a fail.

The results of the can pour test wherein lubricating oil compositions types 1 and 2 are formulated with various pour point depressants and mixtures thereof are set forth in Table II.

TABLE II

| Example | Additive | wt. % | Oil 1 | Oil 2 |
|---|---|---|---|---|
| 1 | B | 0.3 | 0 ml. | — |
| 2 | C | 0.3 | 830 ml. | 635 ml. |
| 3 | C | 0.2 | 765 ml. | 730 ml. |
| 4 | D | 0.3 | 0 ml. | — |

TABLE II-continued

| Example | Additive | wt. % | Oil 1 | Oil 2 |
|---|---|---|---|---|
| 5 | E | 0.3 | 0 ml. | 0 ml. |
| 6 | B | 0.1 | 6'40" | 6'35" |
| | D | 0.2 | | |
| 7 | B | 0.15 | 7'26" | 9'47" |
| | D | 0.15 | | |
| 8 | B | 0.15 | | |
| | D | 0.10 | 6'00" | 11'10" |
| 9 | B | 0.10 | | |
| | E | 0.20 | 12'00" | 14'15" |

It is readily seen from the data of Table II that formulating in only one pour depressant at 0.3 wt. % yielded only Can Pour Test failures yet the mixtures in accordance with the teachings of this invention resulted in passes, in fact Examples 6, 7 and 8 clearly show synergism of the combination when compared with related Examples 1 and 4.

It has also been discovered that a useful additive package for treating the blended lubricating oil base stocks according to this invention, a package which comprises the ethylene copolymeric V.I. improver and the combination of pour depressants according to this invention dissolved in a major amount of a diluent mineral oil and has the valued property of compatability. The following Table III describes the additive package of the invention.

TABLE III

| | Weight % | |
|---|---|---|
| | Broad Range | Narrow Range |
| Low Ethylene Content Ethylene Copolymeric V.I. improver, e.g. Polymer A | 4–14 | 6–12 |
| Alkyl Aromatic Condensation Products, e.g. Polymer B | 0.5–2.5 | 0.75–1.5 |
| Polyester Pour Point Depressand, e.g. Polymers C and E | 0.5–2.5 | 0.75–1.5 |
| Diluent Mineral Oil | Balance | Balance |

A typical additive package consists of about 5.8 wt. % Polymer A, 0.75 wt. % Polymer B, 0.75 wt. % Polymer E and 92.7 wt. % diluent mineral oil, e.g. Solvent 100 Neutral. This package is admixed as by stirring together the blending lubricating oil stock comprising at least two light distillate blending components and a heavy petroleum component. Thus, it is seen that useful additive packages of the invention contain from about 81 to 95 percent by weight diluent mineral oil having dissolved therein an ethylene copolymer having from 40–50 wt. % ethylene in an amount ranging from about 4 to 14 wt. % and from about 0.5–2.5 wt. % each of an oil soluble pour point depressant of the alkyl aromatic condensation and polyester types indicated in Table III. Compatability of such additive packages has been shown by storage for 4 weeks at above 55° C. without phase separation.

The invention in its broader aspect is not limited to the specific details shown and described and departures may be made from such details without departing from the principles of the invention and without sacrificing its chief advantages.

What is claimed is:

1. A lubricating oil composition comprising a lubricating oil and a viscosity index improving amount of an oil-soluble polymer composition consisting essentially of a copolymer of ethylene and a $C_3$ to $C_{18}$ higher alpha-olefin and having an ethylene content of 40–50 wt. %, said lubricating oil blended from a major proportion of at least one light blending distillate having a viscosity of from about 63 to 77 SUS at 37.8° C., and a second light blending distillate having a viscosity of from about 138 to 152 SUS at 37.8° C., and formulated with a mixture of pour depressants comprising:

(a) from about 0.05 to about 0.75 wt. % of an oil-soluble condensation product of a chlorinated long-chain alkyl hydrocarbon having from about 10 to about 50 carbon atoms and a mono- or dinuclear aromatic hydrocarbon and, (b) from about 0.05 to about 0.75 wt. % of an oil-soluble polyester pour depressant of the class consisting of a polymeric ester of acrylic acid or methacrylic acid and a monohydric alcohol containing from 10 to 18 carbon atoms, an interpolymer of a vinyl alcohol ester of a $C_2$ to $C_{18}$ alkanoic acid and a di($C_6$–$C_{18}$ alkyl) fumarate and mixtures thereof, the weight ratio of (a) to (b) ranging from about 3:1 to 1:3.

2. A lubricating oil composition as claimed in claim 1 wherein said higher alpha olefin is propylene, said oil-soluble condensation product is of a paraffin wax and naphthalene having A ($\overline{M}_w$) of between 1000 and 3000, and said ratio ranges from about 2:1 to 1:2.

3. A lubricating oil composition as claimed in claim 2 wherein said oil-soluble condensation product is of chlorowax and naphthalene having a ($\overline{M}_n$) of about 2000 and said polymeric ester is a polymer of $C_{12}$–$C_{20}$ linear alkyl methacrylate esters having a ($\overline{M}_n$) of about 25,000 in which the alkyl groups are predominantly dodecyl, tridecyl and tetradecyl.

4. A lubricating oil composition as claimed in claim 2 wherein said oil-soluble condensation product is of chlorowax and naphthalene having a ($\overline{M}_n$) of about 2000 and said interpolymer is a polymer of dialkyl fumarate and vinyl acetate having a ($\overline{M}_n$) of about 15,000 with the alkyl groups of said fumarate derived from a mixture of $C_{10-18}$ alcohols and the fumarate to acetate molar ratio being substantially 1.

5. A lubricating oil composition as claimed in claim 2 wherein said blended lubricating oil contains a minor proportion of a heavy petroleum component, greater than about 55 wt. % of said light blending distillates have a viscosity of less than 170 SUS at 37.8° C. said polymeric ester is a methacrylic ester copolymer wherein the alkyl moieties are derived from a mixture of said alcohols having linear hydrocarbyl chains containing from 12 to 18 carbons and has a ($\overline{M}$n) ranging from about 2000 to 30,000, and said interpolymer is a copolymer of di($C_6$–$C_{18}$ alkyl) fumarate and vinylacetate having an Mn in the range of about 2,000 to 30,000.

6. A lubricating oil composition as claimed in claim 5 wherein said heavy petroleum component is of the class of bright stock having a viscosity of 125 to 165 SUS at 99° C. and a heavy hydrotreated residue having a viscosity of 65 to 105 SUS at 99° C. and constituting from about 5 to 20 wt. % of the lubricating oil composition and the ethylene content of said copolymer is about 44 wt. %.

7. The method of treating a lubricating oil, having a characteristic viscosity index and pour point, to improve the viscosity index without adversely affecting the pour point which comprises: (1) adding to said lubricating oil a viscosity index improving amount of an oil-soluble copolymer which consists essentially of ethylene and a $C_3$ to $C_{18}$ higher alpha-olefin having an ethylene content of from 40 to 50 wt. %, said lubricating oil comprising a major weight proportion of at least two blends of petroleum distillates containing waxy components; and (2) thereafter formulating said lubricating oil with from about 0.15 to about 1 wt. % of a combination of pour point depressants comprising (a) from about 0.05 to about 0.75 wt. % of an oil-soluble condensation product of a chlorinated wax of from about 10 to about 50 carbons and a mono- or di-nuclear aromatic hydrocarbon; and, (b) from about 0.05 to about 0.75 wt. % of an oil-soluble polymer of a $C_{10-18}$ alkyl acrylate or methacrylate and/or an interpolymer of a vinyl alcohol ester of a $C_2$ to $C_{18}$ alkanoic acid and a di($C_6$–$C_{18}$ alkyl) fumarate whereby the cold temperature performance of said oil is improved.

8. An oil-soluble concentrate adapted to be used as a viscosity index modifier for a lubricating oil blended from at least two light blending distillates containing waxy components, said distillates providing the major weight proportion of the formulated lubricating oil composition which comprises from about 4 to 14 wt. % of an ethylene-propylene copolymer which has an ethylene content of from 40 to 50 wt %. and has a ($\overline{M}_n$) of from about 40,000 to 200,000, from about 0.5 to about 2.5 wt. % of an oil-soluble condensation product of a chlorinated wax of from about 10 to about 50 carbons and a mono- or dinuclear aromatic hydrocarbon and from about 0.5 to about 2.5 wt. % of an oil-soluble polyester pour point depressant of the class consisting of a polymeric ester of acrylic acid or methacrylic acid and a monohydric alcohol containing from 10 to 18 carbon atoms, an interpolymer of a vinyl alcohol ester of a $C_2$ to $C_{18}$ alkanoic acid and a di($C_6$–$C_{18}$ alkyl) fumarate and mixtures thereof in a major weight proportion of mineral oil.

9. An oil-soluble concentrate according to claim 8 wherein said aromatic hydrocarbon is naphthalene, the molecular weight of said condensation product is an ($\overline{M}$n) of about 2000 and said polymeric polymer of dialkyl fumarate and vinyl acetate having a ($\overline{M}_n$) of about 15,000 with the alkyl groups of said fumarate derived from a mixture of $C_{10-18}$ alcohols and the fumarate to acetate molar ratio being substantially 1.

10. An oil-soluble concentrate according to claim 8 wherein said aromatic hydrocarbon is naphthalene, the molecular weight of said condensation product is an ($\overline{M}_n$) of about 2000 and said interpolymer is a polymer of dialkyl fumarate and vinyl acetate having a ($\overline{M}_n$) of about 15,000 with the alkyl groups of said fumarate derived from a mixture of $C_{10-18}$ alcohols and the fumarate to acetate molar ratio being substantially 1.

* * * * *